US006042334A

United States Patent [19]

Schilling

[11] Patent Number: 6,042,334

[45] Date of Patent: Mar. 28, 2000

[54] COMPRESSOR INTERSTAGE SEAL

[75] Inventor: Jan C. Schilling, Middletown, Ohio

[73] Assignee: General Electric Company, Cincinnati, Ohio

[21] Appl. No.: 09/134,828

[22] Filed: Aug. 17, 1998

[51] Int. Cl.[7] ..... F01D 5/00

[52] U.S. Cl. ..... 415/173.7; 415/170.1

[58] Field of Search ..... 415/170.1, 173.7, 415/174.2, 175, 191, 230, 231

[56] References Cited

U.S. PATENT DOCUMENTS

| | | | |
|---|---|---|---|
| 2,812,159 | 11/1957 | Krebs | 415/119 |
| 3,601,414 | 8/1971 | Vemulapalli | 415/174.2 X |
| 3,730,640 | 5/1973 | Rice et al. | 415/117 |
| 3,966,356 | 6/1976 | Irwin | 415/173.3 |
| 4,053,254 | 10/1977 | Chaplin et al. | 415/116 |
| 4,285,633 | 8/1981 | Jones | 415/191 |
| 4,395,195 | 7/1983 | De Cosmo et al. | 415/137 |
| 4,621,976 | 11/1986 | Marshall et al. | 415/191 |
| 4,767,267 | 8/1988 | Salt et al. | 415/174 |
| 4,897,021 | 1/1990 | Chaplin et al. | 415/173.7 |
| 5,188,507 | 2/1993 | Sweeney | 415/173.1 |
| 5,195,868 | 3/1993 | Plemmons et al. | 415/177 |
| 5,328,328 | 7/1994 | Charbonnel et al. | 415/173.7 |
| 5,346,362 | 9/1994 | Bonner et al. | 415/191 |
| 5,707,207 | 1/1998 | Benoist et al. | 415/173.4 |
| 5,749,701 | 5/1998 | Clarke et al. | 415/115 |
| 5,846,050 | 12/1998 | Schilling | 415/135 |

FOREIGN PATENT DOCUMENTS

| | | | |
|---|---|---|---|
| 2022720 | 12/1979 | United Kingdom | 415/173.7 |

*Primary Examiner*—John E. Ryznic
*Attorney, Agent, or Firm*—Andrew C. Hess; Nathan D. Herkamp

[57] ABSTRACT

An interstage seal includes a seal pad attached to a backing strip. A plurality of tab springs are fixedly attached to the outboard side of the strip for engaging an inner band of the supporting stator sector.

10 Claims, 2 Drawing Sheets

COMPRESSOR INTERSTAGE SEAL

BACKGROUND OF THE INVENTION

The present invention relates generally to gas turbine engines, and, more specifically, to air compressors therein.

A typical aircraft turbofan gas turbine engine includes a multistage axial compressor for sequentially pressuring air. The compressor includes a rotor having a plurality of axially spaced apart rows of compressor rotor blades extending radially outwardly therefrom. Surrounding the rotor is an annular casing from which extends radially inwardly a plurality of rows of compressor stator vanes which cooperate with respective blade rows for compressing the air in stages.

A fixed stator vane stage is typically formed in a plurality of circumferentially adjoining sectors which are removably attached to the casing. Each sector includes an arcuate outer band, an arcuate inner band, and several stator vanes extending radially therebetween. The outer band includes forward and aft rails which engage corresponding hooks or slots in the casing for mounting the sectors thereto. The inner band is suspended radially outwardly of the compressor rotor and axially between adjacent rows of rotor blades.

Since the blades sequentially pressurize the air from stage to stage, a differential pressure exists axially across each of the stator stages. Accordingly, an interstage seal is mounted from the inner bands and cooperates with a plurality of sealing teeth extending radially outwardly from the compressor rotor for effecting a labyrinth seal at each stator stage.

The interstage seal is typically attached to the compressor sectors by a backing strip having opposite axial rails which engage complementary hooks formed in the inner bands. A seal pad is attached to the backing strip and is typically in the form of a honeycomb for cooperating with the rotor teeth and effecting a fluid seal.

Since the compressor sections and interstage seals are fabricated assemblies, they are subject to typical manufacturing tolerances and assembly stackup. These components are typically manufactured from sheet metal which experiences variability in the assembly of the seal strips into the inner bands. The seal mounting hooks on the inner band are typically C-section sheet metal portions which are also arcuate in the circumferential direction along the sector. The corresponding rails of the backing strip must be similarly arcuate in curvature so that they may be assembled by circumferential insertion into the corresponding C-hooks.

In this arrangement, radial clearance is necessarily found between the rails and the mounting hooks which leads to wear during operation which can adversely affect the useful life. Manufacturing differences in curvature of the rails and the mounting hooks effect point contacts therebetween which localize wear and decrease friction damping during operation. In one design, the mounting hooks are crimped at several locations after assembly of the seal to the inner band for reducing the clearances therebetween and to increase friction damping. However, the sheet metal components have inherent resiliency which prevents the complete elimination of clearance therebetween even after the crimping operation.

Furthermore, since the seal is subject to occasional rubs by the rotor seal teeth during operation, suitable stops are provided in the inner band to prevent circumferential rotation of the seal segments therein. In one design, one of the circumferential ends of the C-hooks is crimped to effect such a stop. Rub reaction loads are therefore concentrated at these individual stops which increases the stress thereat.

Accordingly, the inherent looseness of the seal in the inner band, and vibratory and rub loads at local contact points cause associated wear thereat which can significantly reduce the useful life of the seal, or sector, or both.

Accordingly, it is desired to provide an interstage seal having an improved mounting to the compressor stators for reducing wear and increasing damping thereof.

BRIEF SUMMARY OF THE INVENTION

An interstage seal includes a seal pad attached to a backing strip. A plurality of tab springs are fixedly attached to the outboard side of the strip for engaging an inner band of the supporting stator sector.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
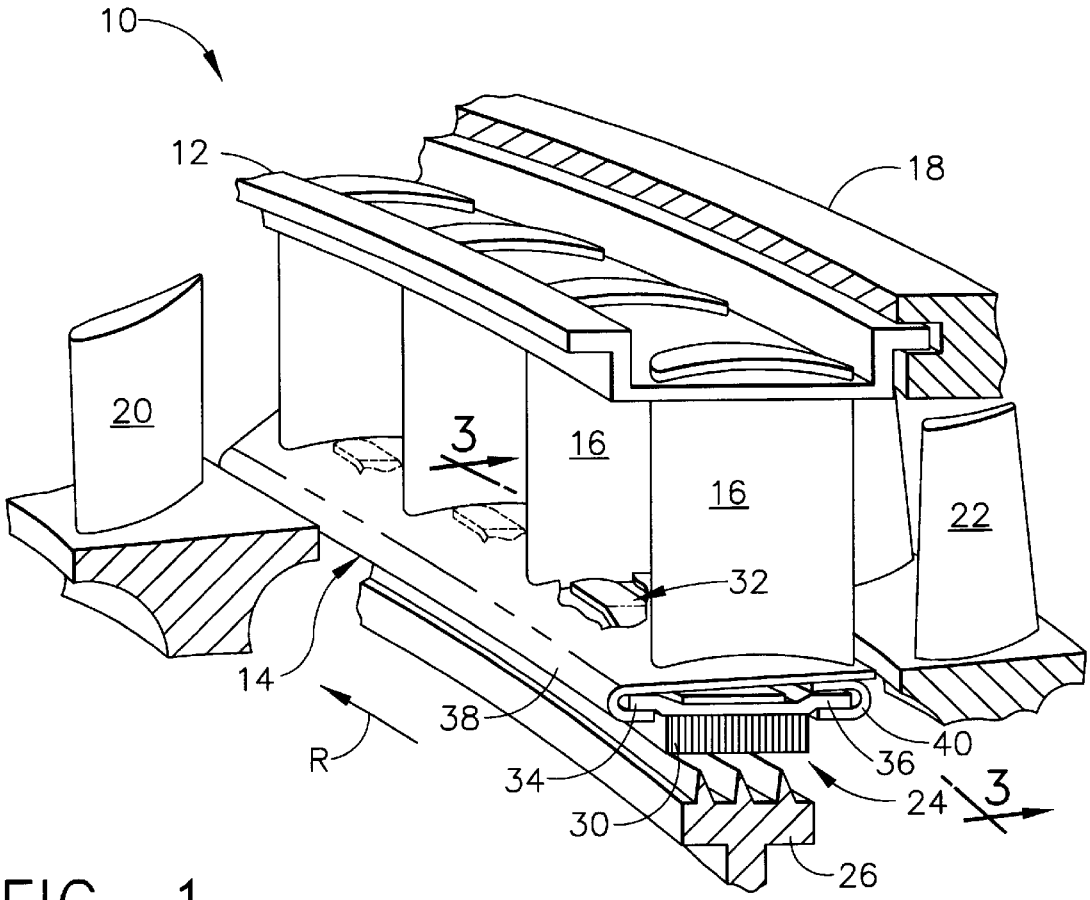
FIG. 1 is an isometric view of a portion of a compressor stator sector supporting an interstage seal in accordance with an exemplary embodiment of the present invention mounted between rotor stages.

Illustrated in FIG. 1 is a portion of an annular compressor stator 10 of a gas turbine engine. The stator 10 is typically formed in a plurality of circumferentially adjoining sectors, with each sector including an arcuate radially outer band 12 and a corresponding arcuate radially inner band 14 spaced inwardly therefrom between which extend a plurality of circumferentially spaced apart compressor stator vanes 16 suitably attached to the corresponding bands by brazing for example.

The outer band 12 has forward and aft rails which engage corresponding hooks or slots in an annular outer casing 18, shown in part, from which the compressor stator is suspended.

The individual vanes 16 are fixedly attached to the outer and inner bands and define one of several compressor stator stages which cooperate with an upstream row of compressor rotor blades 20 and a downstream row of rotor blades 22. The rotor blades 20,22 extend radially outer from corresponding rotor disks which are powered by a turbine (not shown) for compressing air sequentially from stage-to-stage of the multistage compressor.

Since air pressure increases from stage-to-stage in the compressor, an interstage seal 24 is configured and mounted in accordance with a preferred embodiment of the present invention to the inner band 14 for sealing the inboard side of the inner band 14 between the adjacent upstream and downstream rotor stages. The interstage seal 24 cooperates with an interstage seal ring 26 which rotates with the rotor blades 20,22 during operation. In particular, the seal 24 cooperates with a plurality of seal teeth extending radially outwardly from the ring 26 to define a labyrinth seal between adjacent rotor stages.

Figure 2:
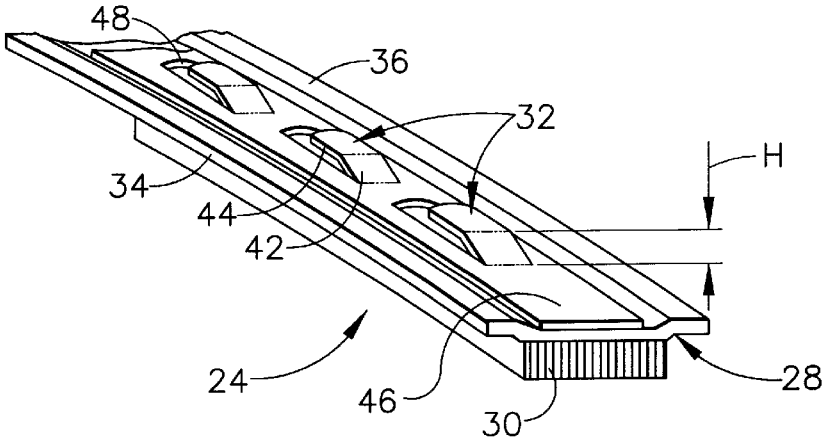
FIG. 2 is an isolated, isometric view of a portion of the interstage seal illustrated in FIG. 1 in accordance with an exemplary embodiment.

The interstage seal 24 is illustrated installed in FIG. 1 and in isolated view in FIG. 2 for clarity of presentation. The seal 24 includes an arcuate backing strip 28 which is preferably sheet metal. A seal pad 30 is fixedly bonded or otherwise attached to a radially inboard side of the strip, and is typically a metallic honeycomb which cooperates with the rotor teeth for effecting the fluid seal.

The seal 24 also includes a plurality of circumferentially spaced apart tab springs 32 which are fixedly attached to an opposite, radially outboard side of the strip and are configured in accordance with a preferred embodiment of the present invention for being resiliently compressed in the inner band 14 to completely eliminate radial stackup clearance therebetween.

As shown initially in FIG. 2, the backing strip 28 includes a pair of arcuate mounting rails 34,36 extending circumferentially along opposite forward and aft axial sides thereof. As shown in FIG. 1, the forward and aft rails 34,36 are configured for slidingly mounting the seal to complementary C-hooks 38,40 in the compressor stator. The inner band 14 is preferably also made of sheet metal, with the forward hook 38 being a portion thereof, and the aft hook 40 being a separately attached sheet metal member fixedly joined thereto by brazing for example. The hooks 38,40 are formed by bending to include complementary C-shaped slots therein which extend circumferentially for circumferentially receiving the corresponding rails 34,36 during assembly.

Since the seal rails 34,36 must be inserted through the corresponding hooks 38,40 during assembly, the latter are necessarily larger than the former to prevent binding therebetween which would restrain assembly thereof. Accordingly, once the seal 24 is assembled into the corresponding inner band 14, a radial stackup clearance necessarily exists therebetween which may be completely eliminated at the corresponding locations of the several tab springs 32.

Figure 3:
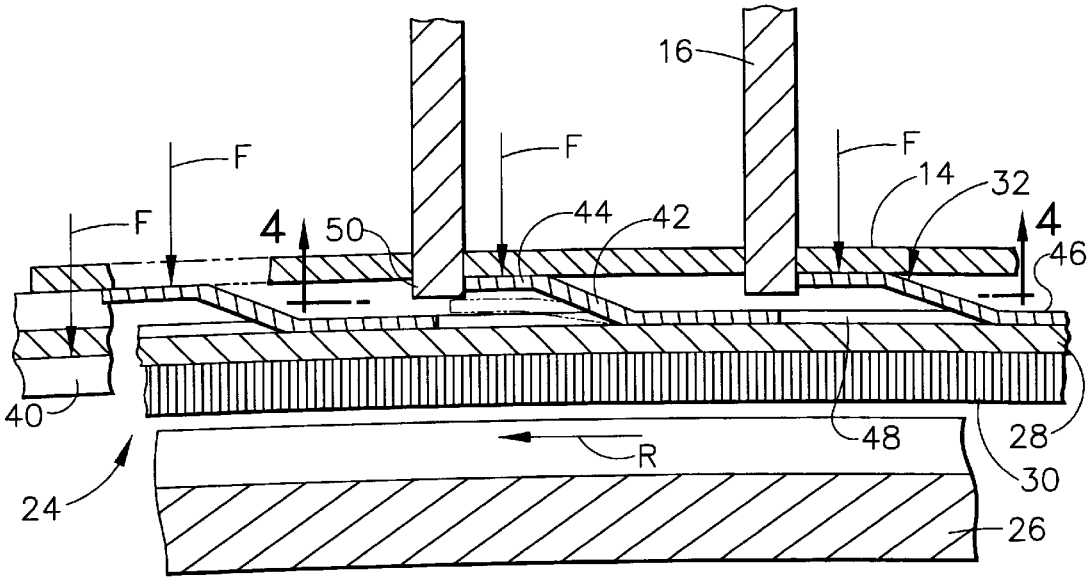
FIG. 3 is an elevational, partly sectional view of the inboard portion of the compressor sector and attached seal illustrated in FIG. 1 and taken along line 3—3.

As shown in FIG. 2, the individual springs 32 are sized in height H for being resiliently compressed in the stator for engaging the rails 34,36 in compression loading against the corresponding hooks 38,40. As shown in FIG. 3, the individual springs 32 are slightly compressed after assembly for effecting a radially inwardly directed compression force F which drives or urges the rails 34,36 radially inwardly against the corresponding hooks 38,40.

Since the backing strip 28 is a sheet metal component, it has inherent flexibility, with the collective compression forces F being distributed substantially uniformly along the entire circumferential extent of the rails and hooks. The compression force not only eliminates radial stackup clearances but also provides frictional restraint therebetween which increases frictional damping during operation. Accordingly, a substantial reduction in wear of the mounting rails and corresponding hooks may be achieved.

As initially shown in FIG. 2, the individual springs 32 are preferably cantilevered from the backing strip 28, and are resiliently flexible to effect the compression loading F. Each spring 32 preferably includes an inclined ramp 42 extending outwardly from the backing strip 28, with an integral flat tab 44 at a distal end thereof.

The springs 32 are preferably formed in a discrete metal sheet 46 fixedly attached to the top of the backing strip 28, by brazing for example. The springs 32 extend integrally from the sheet 46.

In particular, the sheet 46 preferably includes cutouts or apertures 48 which are complementary with the individual springs 32 from which the springs are plastically stamped out in an outward direction therefrom during manufacture. The sheet 46 is initially flat during manufacture and the individual springs 32 may be formed by stamp cutting the perimeter thereof on three sides, leaving the fourth side intact which forms the root of the ramp 42. The ramp 42 and tab 44 are bent outwardly from the main sheet 46 to the corresponding height H to ensure the compression thereof when the seal 24 is assembled into the inner band 14.

As shown in phantom in FIG. 3, each of the tab springs 32 is automatically compressed by obstructions or projections inside the inner band 14 as the seal is circumferentially assembled into the inner band. The seal 24 is mounted in position with the rails 34,36 engaging the corresponding hooks 38,40, and the springs engaging the inner band 14. In particular, the individual tabs 44 of the springs engage the inner surface of the inner band 14 in compression which urges radially inwardly the backing strip 28 and the rails 34,36 thereof in compression engagement with the corresponding hooks 38,40.

Figure 4:
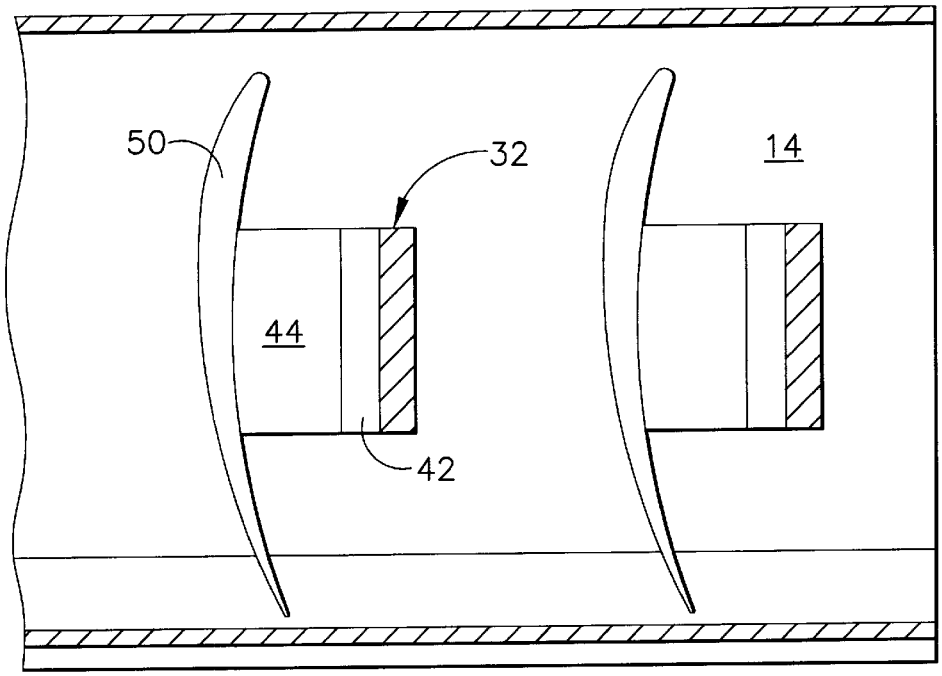
FIG. 4 is an outboard facing, partly sectional view through tab springs of the interstage seal engaging corresponding vanes of the sector illustrated in FIG. 3 and taken along 4—4.

As shown in FIGS. 3 and 4, each of the vanes 16 may include an extension or root 50 extending radially inwardly through the inner band, and the corresponding springs 32 tangentially or circumferentially engage respective ones of the vane roots 50 in abutment to prevent movement thereof therepast. The individual tabs 44 have a suitably large area for spreading the compression loads against corresponding portions of the inner band 14, and have a distal edge which engages the vane roots to provide an improved anti-rotation feature having increased ability to restrain occasional rubbing forces from the teeth of the seal ring 26 against the seal pad 30 which may occur during operation as shown in FIG. 1.

The direction of rotation of the seal ring 26 is illustrated by the counterclockwise direction arrow labeled R which will cause a frictional rubbing force in the same circumferential direction on the interstage seal 24 itself. These rub forces are restrained by the specifically configured tab springs 32 disposed in abutting engagement with the corresponding vane roots 50.

As shown in FIG. 3, the ramps 42 are preferably inclined to intermittently engage the vane roots 50 during circumferential insertion of the rails in the hooks in a first, clockwise direction which is opposite the counterclockwise direction of rotation R of the seal ring 26 which effects the rub forces. The ramps 32 act as resilient cams or ratchet teeth which ratchet past the corresponding vane roots 50 during circumferential assembly of the seal 24. Once the individual tabs 44 are rotated past the corresponding vane roots 50, they resiliently expand to engage corresponding portions of the inner band 14, and their distal ends adjoin corresponding sides of the vane roots 50.

In this way, the tabs 44 engage the vane roots 50 to prevent movement thereof in an opposite second direction which is the same as the counterclockwise direction of rotor rotation R. Rub loads from the seal ring 26 will then be carried to the seal pad 30 in the counterclockwise direction illustrated in FIG. 3 which in turn are carried through the backing strip 28 and metal sheet 46 to the individual springs 32. The rub loads are reacted by engagement of the several tabs 44 with the vane roots 50, with the rub loads then entering the inner band 14.

In the exemplary embodiment illustrated in the figures, three of several tab springs 32 are illustrated for an individual interstage seal 24. Since each sector of the compressor stator 10 typically includes several of the vanes 16, 5 to 9 for example, the number of tab springs 32 may be suitably varied from a preferred minimum of three, with one at each circumferential end of the sector and one in the middle thereof. In this way, both the compression loads F and rub loads are uniformly distributed over the entire circumferential extent of the arcuate inner band 14. A single tab spring 32 or any number thereof may be used in alternate embodiments.

An additional advantage of the dual purpose tab springs 32 is the ability to eliminate the conventional anti-rotation device previously effected by crimping one end of the forward and aft hooks 38,40. Accordingly, the hooks 38,40 may preferably include constant height slots between the opposite circumferential ends of the inner band 14 along the full extent thereof which receive corresponding ones of the rails 34,36. The hooks are therefore characterized by the lack of crimping thereof which allows the individual interstage seals 24 to be assembled in the hooks by circumferential insertion from one end thereof and removed in the same direction.

The seals 24 may be readily removed by withdrawing from the opposite end thereof which ratchets downwardly the individual springs as the seal is removed. Anti-rotation is still effected in the opposite direction by engagement of the springs 32 with the corresponding vane roots 50. The individual seal segments are circumferentially trapped in the corresponding inner bands, and therefore self retailed, after all of the stator sectors are assembled in a complete ring.

The improved interstage seal 24 disclosed above still enjoys the benefits of low cost fabrication using sheet metal components while resolving the inherent radial clearances effected by stackup tolerances. The tab springs 32 eliminate radial looseness of the seal by creating the compression loading F over the large contact area of the tabs 44 which urges the forward and aft rails 34,36 into abutting engagement with the corresponding forward and aft hooks 38,40 along substantially their entire circumferential extent. This increases the effective area of contact between the rails and hooks, and correspondingly decreases unit loads and wear therebetween. This also increases the available friction damping therebetween which further reduces wear of these components.

The associated anti-rotation feature of the individual springs 32 engaging the corresponding vane roots 50 provides greater contact area for reacting tangential rub seal loads, and will decrease anti-rotation stresses attributable thereto. The anti-rotation feature also eliminates the need for crimping of the hooks and the corresponding cost associated therewith.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

I claim:

1. An interstage seal for a compressor stator comprising:

an arcuate backing strip;

a seal pad fixedly attached to an inboard side of said strip; and a plurality of spaced apart tab springs fixedly attached to an opposite, outboard side of said strip.

2. A seal according to claim 1 wherein:

said backing strip includes a pair of mounting rails extending circumferentially along opposite sides thereof for mounting said seal to complementary hooks in said compressor stator; and said springs are sized for being compressed in said stator for engaging said rails in compression against said hooks.

3. A seal according to claim 2 wherein said springs are cantilevered from said backing strip, and are resiliently flexible to effect said compression.

4. A seal according to claim 3 wherein each of said springs includes a ramp extending outwardly from said backing strip, with an integral tab at a distal end thereof.

5. A seal according to claim 4 further comprising a metal sheet attached to said backing strip, and including said springs integrally extending therefrom.

6. A seal according to claim 5 wherein said sheet includes apertures complementary with said springs from which said springs are plastically stamped outwardly therefrom.

7. A seal according to claim 3 in combination with said compressor stator, and said stator further comprises:

an outer band;

an inner band including said hooks;

a plurality of circumferentially spaced apart stator vanes extending therebetween; and said seal is mounted with said rails engaging said hooks, and said springs engaging said inner band.

8. An apparatus according to claim 7 wherein said vanes include roots extending radially inwardly through said inner band, and said springs circumferentially engage respective ones of said vane roots to prevent movement therepast.

9. An apparatus according to claim 8 wherein said ramps are inclined to intermittently engage said vane roots during circumferential insertion of said rails in said hooks in a first direction to ratchet therepast, with said tabs engaging said vane hooks to prevent movement thereof in an opposite second direction.

10. An apparatus according to claim 8 wherein said hooks include constant height slots between opposite ends of said inner band receiving corresponding ones of said rails.

* * * * *